US010282924B2

(12) United States Patent
Drew et al.

(10) Patent No.: US 10,282,924 B2
(45) Date of Patent: May 7, 2019

(54) SYSTEM AND METHOD FOR SENDING AND RECEIVING MESSAGES BETWEEN AN ELECTRONIC CONTROL UNIT OF A VEHICLE AND AN EXTERNAL DEVICE

(71) Applicant: Drew Technologies, Inc., Ann Arbor, MI (US)

(72) Inventors: Michael Drew, Dexter, MI (US); Brian Herron, Dexter, MI (US); Eric Wheeler, Chelsea, MI (US); Gus Nassar, Canton, MI (US)

(73) Assignee: DREW TECHNOLOGIES, INC., Ann Arbor, MI (US)

( * ) Notice: Subject to any disclaimer, the term of this patent is extended or adjusted under 35 U.S.C. 154(b) by 497 days.

(21) Appl. No.: 14/231,916

(22) Filed: Apr. 1, 2014

(65) Prior Publication Data

US 2014/0297099 A1 Oct. 2, 2014

Related U.S. Application Data

(60) Provisional application No. 61/807,074, filed on Apr. 1, 2013.

(51) Int. Cl.
*G07C 5/00* (2006.01)
*G07C 5/08* (2006.01)

(52) U.S. Cl.
CPC ..... *G07C 5/0808* (2013.01); *G07C 2205/02* (2013.01)

(58) Field of Classification Search
CPC ..... G07C 5/008; G07C 2205/02
See application file for complete search history.

(56) References Cited

U.S. PATENT DOCUMENTS 9,117,319 B2 * 8/2015 Chen ..... G07C 5/008
9,384,599 B2 * 7/2016 Chen ..... G07C 5/008
2005/0267655 A1 * 12/2005 Gessner ..... B60R 16/0231 701/29.1
2007/0043488 A1 * 2/2007 Avery ..... G01R 31/007 701/33.2
2007/0073458 A1 * 3/2007 Webster ..... G07C 5/0808 701/33.9
2009/0276115 A1 * 11/2009 Chen ..... G07C 5/008 701/29.6

(Continued)

*Primary Examiner* — Thomas G Black
*Assistant Examiner* — Ce Li Li
(74) *Attorney, Agent, or Firm* — Brinks Gilson & Lione

(57) ABSTRACT

A device for sending and receiving messages between an electronic control unit of a vehicle and an external device includes a processor, a memory, a first port, and a second port. The memory, first port, and second port are each in communication with the processor. The first port is configures to communicate with the electronic control unit of a vehicle, while the second port is configured to communicate with the external device. The processor is configured to receive a request message from the external device via the second port, transmit the request message to the electronic control unit of the vehicle; receive requested information from the electronic control unit of the vehicle based on the request message, and determine an information subset in the requested information that should be transmitted to the external device; and transmitting the information subset to the external device.

22 Claims, 5 Drawing Sheets

(56) References Cited

U.S. PATENT DOCUMENTS

| | | | | |
|---|---|---|---|---|
| 2010/0161490 | A1* | 6/2010 | Alrabady | H04W 12/08 705/50 |
| 2010/0178872 | A1* | 7/2010 | Alrabady | H04W 4/02 455/41.3 |
| 2013/0158838 | A1* | 6/2013 | Yorke | B60W 10/06 701/103 |
| 2014/0195108 | A1* | 7/2014 | Schumacher | G07C 5/008 701/36 |
| 2015/0206358 | A1* | 7/2015 | Chen | G07C 5/008 701/29.6 |

* cited by examiner

SYSTEM AND METHOD FOR SENDING AND RECEIVING MESSAGES BETWEEN AN ELECTRONIC CONTROL UNIT OF A VEHICLE AND AN EXTERNAL DEVICE

CROSS REFERENCE TO RELATED APPLICATION

This application claims the benefit of U.S. provisional application No. 61/807,074 filed on Apr. 1, 2013 which is herein incorporated by reference in its entirety.

BACKGROUND

1. Field of the Invention

The invention relates to devices for sending and receiving messages between an electronic control unit and an external device, especially with electronic control units of a vehicle and an external device, such as an emissions tester.

2. Description of Related Art

Numerous government municipalities perform periodic testing of emissions outputted automobiles. These emissions testing devices may be standalone devices that only perform emissions testing or may be general purpose computers that are loaded with the appropriate software that performs emissions testing. An emission testing device is generally performed by connecting the emissions tester to a port that is in communication with electrical systems of the vehicle. The communications port is normally located between the dashboard and the brake pedal. It is most likely to be a Society of Automotive Engineers ("SAE") J1962 port—better known as an On-Board Diagnostics II ("OBD-II") port. This port allows communication from connected devices to any of the available busses on the vehicle. The bus is connected to numerous electronic control units located within the vehicle as well as sensor systems that are also located within the vehicle. These sensor systems routinely collect data relating to the operation of the automobile, including emissions related data. The emissions tester connected to the port will then communicate with these systems and electronic control units regarding emissions related information of the vehicle. The emissions testing device or related software will analyze this data and make a determination if the vehicle has met the municipality's standards for emissions relating operation. OBD-II port may be any one of K-Line, J1850PWM, J1850VPW or CAN and that these are on separate pins of the OBD-II port.

However, many automotive enthusiasts commonly perform modifications to their vehicle that may confuse the emissions testing device. This confusion of the emissions testing device can lead the emissions testing device to make a determination that the vehicle has not passed emissions and thereby causing the owner of the vehicle to spend resources to further modify their vehicle to correctly pass emissions. This can occur in situations where the vehicle is passing emissions but because of the confusion caused by the modifications to the emissions tester, the emissions tester reports that the automobile has failed the test.

SUMMARY

The device for sending and receiving messages between an electronic control unit of a vehicle and an external device includes a processor, a memory, a first port, and a second port. The memory, first port, and second port are each in communication with the processor. The first port is configures to communicate with the electronic control unit of a vehicle, while the second port is configured to communicate with the external device.

The processor is configured to receive a request message from the external device via the second port, transmit the request message to the electronic control unit of the vehicle, receive requested information from the electronic control unit of the vehicle based on the request message, and determine an information subset in the requested information that should be transmitted to the external device; and transmitting the information subset to the external device.

Further objects, features and advantages of this invention will become readily apparent to persons skilled in the art after a review of the following description, with reference to the drawings and claims that are appended to and form a part of this specification.

DETAILED DESCRIPTION

Figure 1:
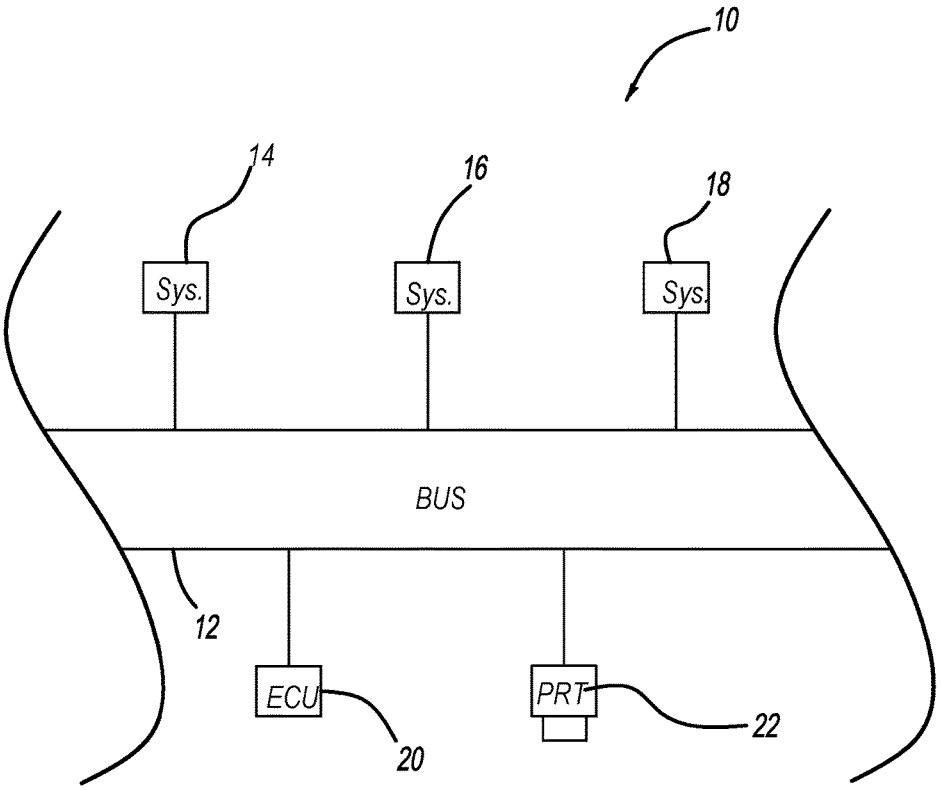
FIG. 1 illustrates a block diagram of an example of a data bus found in a vehicle.

Referring to FIG. 1, an example of an electronic system 10 found within a vehicle is shown. The system 10 generally includes a bus 12 that acts as a conduit to allow communications between varieties of different devices. The bus 12 can be any one of a number of different electronic buses, but generally is a Controller Area Network ("CAN") bus commonly found in automobiles.

In communication with the bus 12 can be a variety of different automobile systems and subsystems. These systems and subsystems include engine related systems 14, GPS or navigation related systems 16 and emissions related systems 18. The engine related systems 14 may control the engine and possibly other powertrain components based on operator input. The GPS or navigation related systems 16 generally relate to providing the operator of the vehicle information regarding the vehicles position and may provide directions to the operator as well. The emissions system 18 generally relates to monitoring the emissions of the vehicle to determine if there are any issues with the vehicle emissions. The emission system 18 also collects data regarding emissions of the vehicle and stores the data.

The bus 12 may also have an electronic control unit 20 connected to the bus 12 for processing information received from any of the systems or subsystems connected to the bus. Like before, electronic control unit 20 may be a single electronic control unit or may be multiple electronic control units located across different systems. Also, the electronic control unit 20 may form all or part of the various subsystems connected to the bus 12, including the engine related systems 14, GPS or navigation related systems 16 and emissions related systems 18. It should be understood that any one of a number of different systems may be connected to the bus 12. Additionally, the systems described above may include more than one single processor and may be spread across a variety of different processors to process information.

Also in communication with the bus 12 is a port 22. The port 22 may be any one of a number of different ports and it should be further understood that the port 22 may also not only be a physical port but could also be a wireless communication point for allowing external devices to communicate with the bus 12. The port 22 may be an OBD-II style port commonly found in automobiles and may be generally located under the dash of the vehicle above the brake pedal. As it is well known, the OBD-II port of the vehicle allows external devices, such as diagnostic devices, to be connected to the port 22 to download diagnostic related information. The port 22 can also be used to reprogram one or more electronic control systems connected to the bus 12 and may also be used to connect to emissions testing devices.

Figure 2:
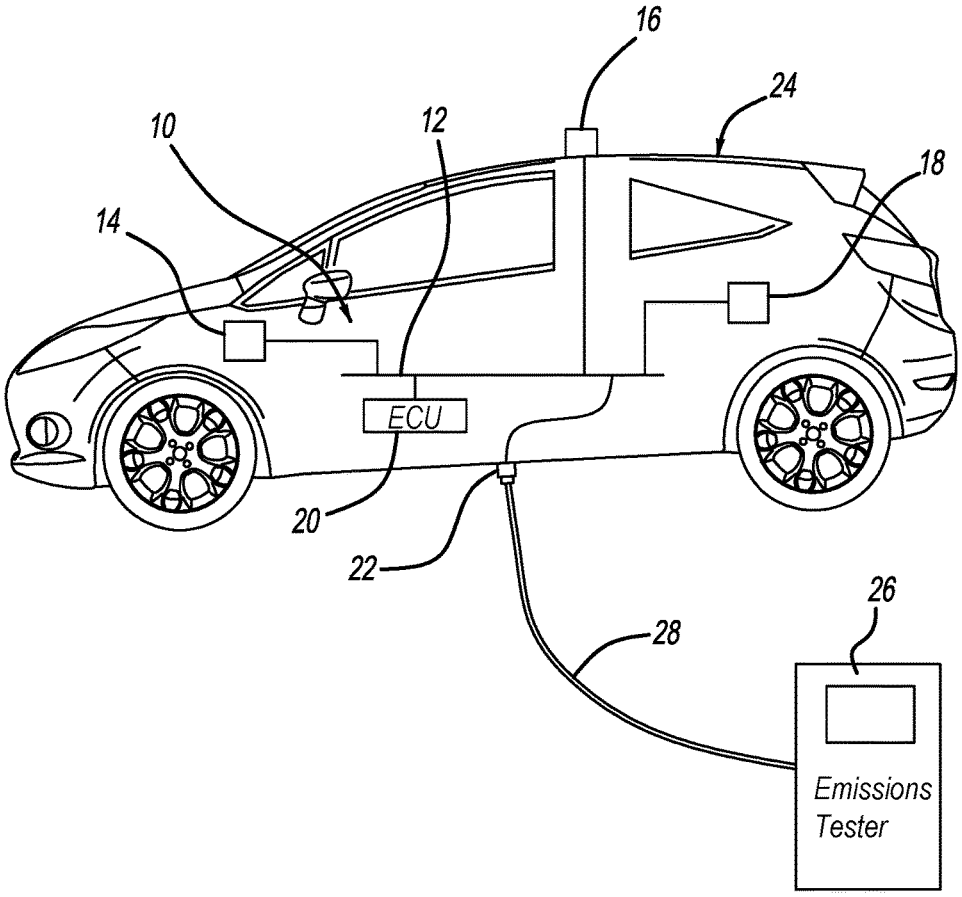
FIG. 2 illustrates a block diagram of a vehicle with the data bus of FIG. 1 connected to an emissions testing device.

FIG. 2 illustrates the bus system 10 located within a vehicle 24. It should be understood that the vehicle 24 could be any one of a number of different types of vehicles. For example, the vehicle 24 may be an automobile, light truck, or sport utility vehicle. The vehicle could also be a heavy duty truck, tractor, tractor trailer, boat, or plane. The vehicle 24 can essentially be any vehicle that is capable of transporting persons or objects between two points.

Here, the system 10 is connected to an emissions testing device 26 via the port 22 using a cable 28. When connected thusly, the emissions testing device 26 can perform emissions testing and can test the emissions subsystem 18 of the vehicle 24 by connecting with the port 22. Data collected from the vehicle 24 is then analyzed by the emissions tester 26 and then a determination is made if the vehicle 24 has passed emissions. If the vehicle 24 does not pass emissions, the operator of the vehicle 24 is notified and usually a substantial expense may be incurred by the operator in order to bring the vehicle 24 up to code.

Figure 3:
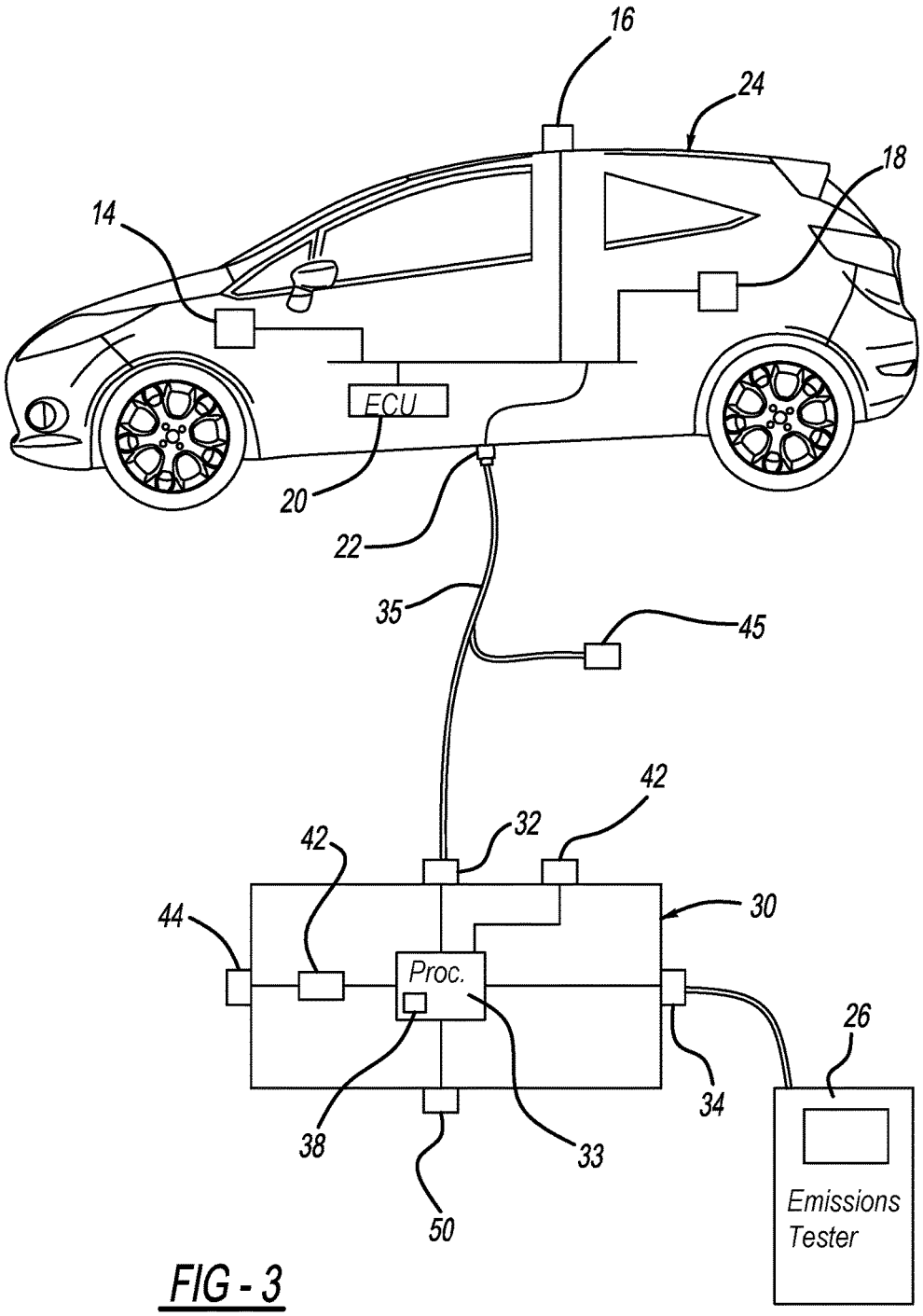
FIG. 3 illustrates the vehicle of FIG. 2 connected to the device for sending and receiving messages between an electronic control unit of the vehicle and the emissions testing device.

FIG. 3 is similar to FIG. 2; however, FIG. 3 differs in that FIG. 3 incorporates a device 30 for communicating between electronic control unit 20 of the vehicle 24 and the external device, which in this example is the emissions tester 26. As its primary components, the device 30 includes a processor 33 and a first port 32 and a second port 34. The first port 32 is configured to communicate with an electronic control unit 20 of the vehicle 24 via a cable 35. The second port 34 is also in communication with the processor 33. The second port 34 is configured to communicate with the emissions tester 26. Both the first port 32 and the second port 34 may follow the OBD-II protocol.

The processor 33 is also in communication with a memory 38. The memory 38 may be located on the processor 33 or may be located away from the processor, but is nevertheless in communication with the processor 33. The memory 38 contains instructions to configure the processor to receive a request message from the emissions tester 26 via the second port 34 and then transmit the request message to the electronic control unit 20 of the vehicle via the first port 32.

The processor 33 is also configured to receive the requested information from the electronic control unit 20 of the vehicle 24 based on the request message and determine an information subset in the requested information through the external device 26. The processor 33 of the device 30 will only transmit information that the processor 33 allows to be transferred to the emissions tester 26. Here, the processor 33 may transmit all of the information received from the electronic control unit 20 of the vehicle 24 to the emissions tester 26 or may only transmit a subset of the information. By so doing, the information provided to the emissions tester 26 may be such that the emissions tester 26 will determine based on the received information that the vehicle 24 has passed emissions. In addition, the processor 33 may transmit all of the information received from the electronic control unit 20 of the vehicle 24 to the emissions tester 26 or a subset of the information and some additional information. As stated before, the goal of this transmission is to make the emissions testing device 26 to determine that the information received from the device 30 is such that the vehicle 24 passes emissions.

The processor 33 may also be configured to determine by communicating with the electronic control unit 20 of the vehicle 24 and store in the memory 38 at least one of the following (1) which OBD2 protocols are present in the electronic control unit 20 of the vehicle 24, (2) if the electronic control unit 20 of the vehicle 24 comprises more than one electronic control unit, (3) which SAE J1979 modes and parameter id's are stored by the electronic control unit 20, (4) a vehicle identification number, (5) calibration identification of the vehicle 24, (6) calibration identification numbers for the electronic control unit 20, (7) how the electronic control unit 20 responds to an improper request, (8) sub-microsecond response time for the electronic control unit 20 and timings related to inter-byte times.

The processor 33 may also be configured to mimic the electronic control unit 20 of the vehicle. The processor 33 may also be configured to remap information received from the electronic control unit 20 of the vehicle 24. This remapping may include scaling information from the electronic control unit 20 of the vehicle 24 or maintaining relationships between at least two vehicle parameters of the vehicle 24. The processor 33 may also be configured to remove controller area network background messages from the bus 12 from the information subset. The processor 33 may also be able to modify non-OBD2 messages in the information subset.

The processor 33 may also be configured to turn vehicle indicator light(s) of the vehicle 24. The processor 33 may also be configures to determine if the indicator light(s) set and then sends the command to clear the indicator light. This clearing of the indicator light would be done very quickly such that someone looking at the indicator light may not see it fully light.

The processor 33 may also be configured to save in the memory 38 at least a portion of the requested message from the external device via the second port 34. The processor 33 may also be configured to send a predetermined message to the external device via the second port 34.

The device 30 may also have a switching device 40 that is in communication with the processor 33. The switching device 40 can act as a way of instructing the processor 33 to either transmit and/or modify data received from the electronic control unit 20 of the vehicle 24 or act simply as a pass through device to pass all data received from the electronic control unit 20 of the vehicle 24 to the emissions tester 26. This essentially allows the operator of the device 30 to turn the device on or off as it relates to modifying information provided to the external testing device 26.

The processor 33 also is configured to know when to transmit specific information to the external device 26 when a predetermined parameter is met. The predetermined parameter may be a predetermined location of the vehicle 24. For example, using the vehicles GPS system 26, the processor 33 may be able to determine a location of the vehicle 24. If the vehicle is located in a place known for having an emissions device 26, the processor 33 may be specifically requested to either transmit or not transmit the requested information. The predetermined parameter may also be a vehicle bus message found on the vehicle bus 12 or may be the switching device 42 previously mentioned.

The device 30 may also have a network communication interface 42. The network communication interface provides a network communication path for communicating with the processor 33 by third party devices. In communication with the network communication device 42 may be a port 44. As such, the network communication device 42 may be a USB type device or other device utilizing the appropriate port 44. However, it should be understood that the network communication device 42 may also be a wireless network communication device and that the port 44 acts as an antenna to communicate wirelessly with third party devices.

The cable 35 may be Y style cable having a secondary port 45. The secondary port 45 acts as a bypass the information provided by the vehicle 24. Instead of connecting the port 34 of the device 30, an operator can simply connect to the port 45 to receive information directly from the vehicle 24 without any additional data added or remover from the device 30. It should also be understood that the device 30 could be placed underneath the dash of the vehicle 24, making the device 30 appear to be nonexistent to personnel operating the emissions tester 26. Also, the device 30 could be embedded in the electrical system of the vehicle 24 and would thus not possibly need port 45.

Figure 4:
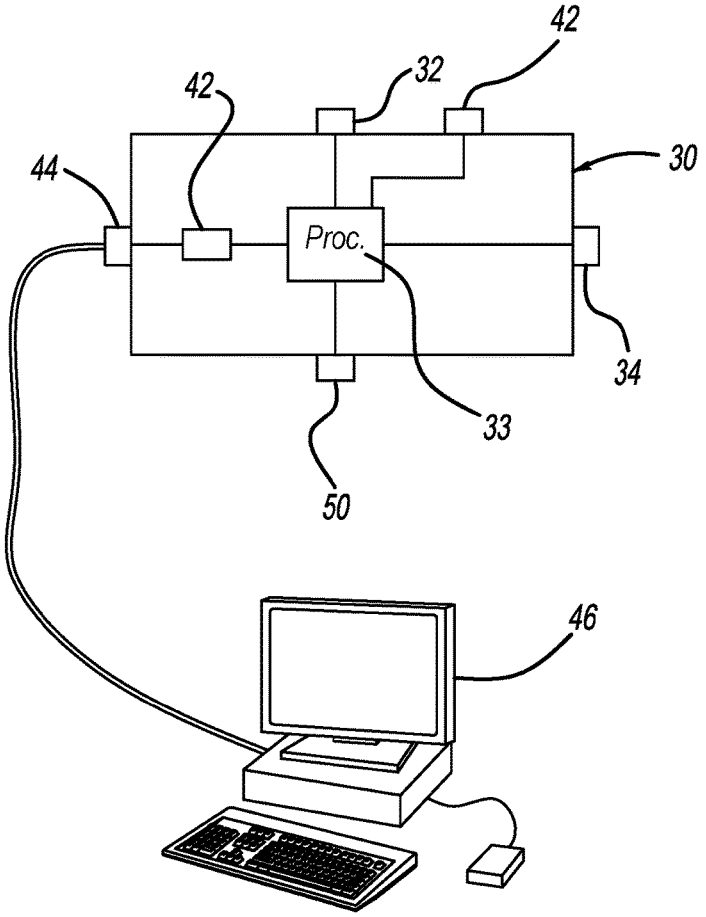
FIG. 4 illustrates the device of FIG. 3 connected to a third party device.

FIG. 4 illustrates a third party device 46 communicating with the device 30 utilizing the port 44. Here, the third party device 46 is a general purpose computer loaded with the appropriate software to allow for communication with the device 30. However, it should be understood that the third party device 46 can be any one of a number of different devices capable of sending and receiving communications with the device 30. Examples could include a dedicated device whose sole purpose is to communicate with the device 30 or could include mobile devices, tablet devices or other devices such as vehicle navigation systems. Here, the processor 33 is configured to allow the third party device 46 to configure the processor 33 to determine what information in the requested information should be transmitted to the external device.

Further, the processor 33 may also be configured to allow the third party device 46 to save information received from the electronic control unit of the vehicle 24. By so doing, the device 30 essentially allows the third party device 46 to download data so that the data can be later analyzed. This data downloaded could be relate to emissions data but could relate to any other vehicles data.

Figure 5:
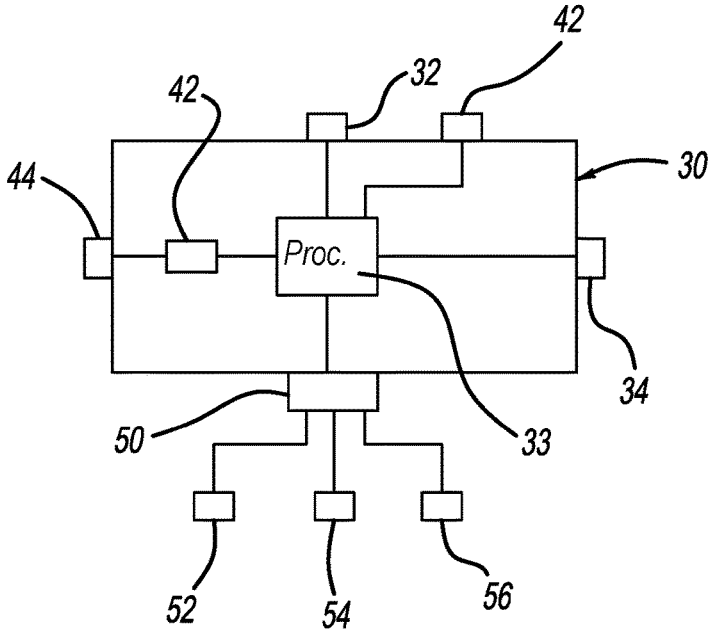
FIG. 5 illustrates the device of FIG. 3 having an analog input for connecting to analog devices.

Referring to FIG. 5, the system 30 includes at least one analog input 50 for communication with a variety of different analog devices 52, 54 and 56. The analog devices 52, 54 and 56 are an inductive pickup, a magnetic sensor, a temperature sensor or a pressure sensor. The processor 33 is configured to receive data from the analog input 50 and process data received from the analog input 50.

The invention claimed is:

1. A device for sending and receiving messages between an electronic control unit of a vehicle and an external device, the device comprising:

a processor;

a memory in communication with the processor;

a first port in communication with the processor, wherein the first port is configured to communicate with the electronic control unit of the vehicle;

a second port in communication with the processor, wherein the second port is configured to communicate with the external device, wherein the external device is a vehicle emissions testing device that is configured to determine that the vehicle has passed an emissions test; and wherein the processor is configured to:

receive a request message from the vehicle emissions testing device via the second port, transmit the request message to the electronic control unit of the vehicle, receive requested information from the electronic control unit of the vehicle based on the request message, determine a first information subset in the requested information that should be transmitted to the vehicle emissions testing device and a second information subset in the requested information that should not be transmitted to the vehicle emissions testing device, wherein the information found in both the first information subset and the second information subset of the requested information was requested in the request message transmit the first information subset to the vehicle emissions testing device, wherein the first information subset provided to the vehicle emissions testing device results in a pass indication by the vehicle emissions testing device, indicating that the vehicle has passed the emissions test based on the first information subset provided to the vehicle emissions testing device, and not transmit the second information subset, wherein the second information subset contains a portion of the requested information that if provided to the vehicle emissions testing device would result in a fail indication by the vehicle emissions testing device.

2. The device of claim 1, wherein the information subset comprises a portion of the requested information and additional information.

3. The device of claim 1, wherein the first port and the second port utilize OBD-II protocol interfaces.

4. The device of claim 1, wherein the processor is further configured to determine by communicating with the electronic control unit of the vehicle and store in the memory at least one of the following: which OBD-II protocols or vehicle busses are present in the electronic control unit of the vehicle, if the electronic control unit of the vehicle comprises more than one electronic control unit, which SAE J1979 modes and parameter IDs are supported by the electronic control unit, a vehicle identification number, calibration identification, calibration identification numbers for the electronic control unit, how the electronic control unit responds to requests, sub microsecond timing of a response time for the electronic control unit and timings related to inter byte times.

5. The device of claim 1, wherein the processor is further configured to mimic the electronic control unit of the vehicle.

6. The device of claim 1, further comprising a network interface in communication with the processor.

7. The device of claim 6, wherein the processor is further configured to allow a third party device via the network interface to configure the processor to determine what information in the requested information should be transmitted to the vehicle emissions testing device.

8. The device of claim 7, wherein the processor is further configured to allow the third party device via the network interface to save the information received from the electronic control unit of the vehicle.

9. The device of claim 1, wherein the processor is further configured to remap information received from the electronic control unit of the vehicle.

10. The device of claim 9, wherein the remapping further comprises scaling the information from the from the electronic control unit of the vehicle.

11. The device of claim 9, wherein the remapping further comprises maintaining relationships between at least two vehicle parameters.

12. The device of claim 1, wherein processor is further configured to remove controller area network background messages from the information subset.

13. The device of claim 1, wherein processor is further configured to modify of non OBD-II messages in the information subset.

14. The device of claim 1, wherein processor is further configured to turn off a vehicle indicator light.

15. The device of claim 1, wherein processor is further configured to save in the memory at least a portion of the request message from the vehicle emissions testing device via the second port.

16. The device of claim 1, wherein processor is further configured to send a predetermined message to the vehicle emissions testing device via the second port.

17. The device of claim 1 further comprising:

at least one analog input in communication with the processor; and wherein the processor is configured to receive data from the analog input.

18. The device of claim 17, wherein at least one of the following is connected to the at least one analog input: an inductive pickup, a magnetic sensor, a temperature sensor or a pressure sensor.

19. The device of claim 1, wherein the processor is configured to transmit to the vehicle emissions testing device the requested information when a predetermined parameter is met.

20. The device of claim 19, wherein the predetermined parameter is a predetermined location of the vehicle.

21. The device of claim 19, wherein the predetermined parameter is vehicle bus message.

22. The device of claim 19, wherein the predetermined parameter is a switching device.

* * * * *